United States Patent [19]

Fair

[11] Patent Number: 4,570,568

[45] Date of Patent: Feb. 18, 1986

[54] SHROUD FOR THERMALLY SPRAYED WORKPIECE

[75] Inventor: Jack E. Fair, Peoria, Ill.

[73] Assignee: Caterpillar Tractor Co., Peoria, Ill.

[21] Appl. No.: 684,414

[22] Filed: Dec. 20, 1984

[51] Int. Cl.[4] ..... B05B 7/20; B05B 15/04

[52] U.S. Cl. ..... 118/69; 118/301; 118/504; 427/423

[58] Field of Search ..... 118/63, 69, 301, 504, 118/505; 427/423

[56] References Cited

U.S. PATENT DOCUMENTS

| | | | |
|---|---|---|---|
| 2,721,535 | 10/1955 | Zitkus | 118/301 |
| 2,946,696 | 7/1960 | Lopenski | 118/301 X |
| 3,377,984 | 4/1968 | Mommsen et al. | 118/301 |
| 4,402,992 | 9/1983 | Liebert | 427/34 |

OTHER PUBLICATIONS

Merle L. Thorpe—"Thermal Spraying Becomes a Design Tool", *Machine Design*, Nov. 24, 1983, pp. 69–77.

*Primary Examiner*—Shrive P. Beck

*Attorney, Agent, or Firm*—Robert A. McFall

[57] ABSTRACT

An apparatus for thermally spraying a coating on a workpiece includes a fluid flow control shroud having a shaped inner surface portion complimentary to a preselected surface of the workpiece. During the coating operation, a supply of pressurized gas is introduced between the inner surface of the shroud and the workpiece surface to exclude deflected coating particles, remove weakly or loosely bonded particles, and cool the workpiece.

3 Claims, 2 Drawing Figures

SHROUD FOR THERMALLY SPRAYED WORKPIECE

DESCRIPTION

1. Technical Field

This invention relates generally to a fluid flow control shroud and more particularly to such a shroud for use with a thermal spray coating system.

2. Background Art

Thermal spray processes can be generally grouped into three categories: flame, electrical heating, and detonation. In each of the processes a material in wire, rod, or powder form is heated, melted to form small descrete particles, and propelled from a gun or torch assembly onto a workpiece. It is often advantageous to provide some form of cooling to prevent overheating of the workpiece surface during deposition of the melted coating. Typically, one or more adjustable air nozzles are mounted on the torch assembly and directed towards the workpiece surface. A pressurized gas, such as air or $CO_2$ is delivered to the nozzle and directed onto the workpiece surface simultaneously with application of the melted coating.

While broadly directed gas streams are beneficial in providing some cooling of the workpiece, other problems are introduced. For example, the physical shape of the workpiece may deflect the gas flow and prevent the flow of a uniform stream of gas onto all desired areas of the workpiece. In particular, it has been found that in the plasma spray coating of journal surfaces on a crankshaft, the counterweight surfaces adjacent each side of the journal bearing surface adversely affect the uniform flow of air to the journal surface during the coating operation. When the crankshaft is rotated in this application, there is an alternating presence and absence of the vertical counterweight wall surfaces adjacent the journal. In addition, the counterweights pass through, or at least deflect, a portion of the cooling air system issuing from the torch-mounted nozzles. This combines to produce a pulsating and/or uneven airflow at the journal surface.

Uneven or pulsating airflow at the journal surface causes an inferior coating. First the workpiece surface, i.e., the substrate surface for the melted coating, is not uniformly cooled. Secondly, overspray particles of coating material may first contact the vertical counterweight surfaces and partially solidify, and then bounce or deflect onto the journal surface. These particles do not bond sufficiently to form a good coating. Loosely bonded particles are often dislodged during subsequent grinding operations thereby leaving a void in the finished journal surface. Thirdly, the rotating counterweight produces air stream tubulence adversely affecting the spray coating and resulting in an uneven coating. The uneven distribution of coating particles is particularly noticeable in the filet areas between the journal and counterweight surfaces.

The present invention is directed to overcoming one or more of the problems set forth above. In particular, an air shroud embodying the present invention, distributes a uniform flow of air over the surface of the workpiece. The air flow over the coated surface is not influenced by adjacent physical features on the workpiece, and loosely bonded particles on the coated surface are blown away. The shroud further acts as a shield to protect the workpiece surface from overspray-produced low energy bouncing particles.

DISCLOSURE OF THE INVENTION

In accordance with one aspect of the present invention, an apparatus for thermally spraying a coating on a workpiece, includes a fluid flow control shroud having a shaped surface portion complimentary to the shape of a coated surface of the workpiece. A conduit for delivering a flow of gas to the surface of the workpiece extends between a source of pressurized gas and the shroud. A support maintains the shaped surface portion of the shroud in a predetermined spaced relationship with respect to the coated surface of the workpiece during the coating operation.

BEST MODE FOR CARRYING OUT THE INVENTION

Figure 1:
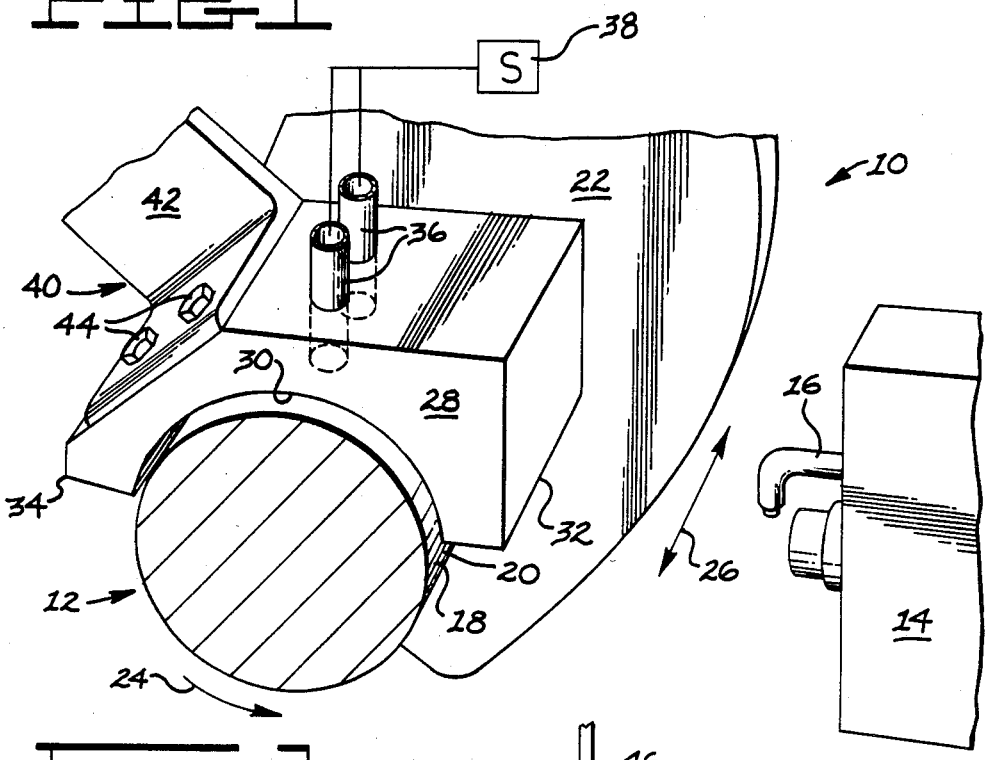
FIG. 1 is a partial view, in perspective, of an apparatus for thermally spraying a coating on a workpiece.

In apparatus 10 for thermally spraying a coating on a workpiece 12 includes a conventional plasma spray gun 14 which generates a superheated gas plasma to melt powder feedstock injected into the plasma stream from a powder feed tube 16. The melted feedstock particles are accelerated by the plasma stream and carried to a preselected surface 18 on the workpiece 12. The workpiece 12 is an engine crankshaft typically having a plurality of piston rod bearing or journal surfaces 20 disposed between pairs of offset counterweights 22. It has been found that worn bearing or journal surfaces on such engine components can be restored to their original dimensions by plasma spraying a suitable metal alloy coating onto the worn surface, and then grinding the coated surface to the desired dimension. In this operation, the crankshaft is mounted in a rotatable fixture and is turned in the direction indicated by the arrow 24 about the longitudinal axis of the particular bearing being coated. During the spraying operation, the plasma gun is traversed back and forth along the length of the bearing surface as indicated by the double-ended arrow 26.

Figure 2:
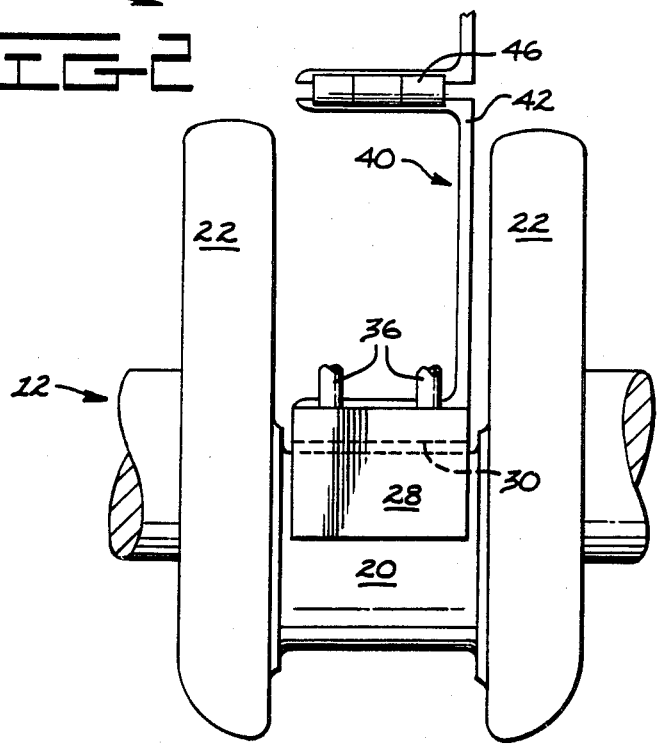
FIG. 2 is a partial elevational view of the embodiment shown in FIG. 1.

In the preferred embodiment, the apparatus 10 also includes a fluid flow control shroud 28 constructed of a metal or other high temperature-resistant material and having a shaped surface portion 30 that is complimentary to the shape of the crankshaft journal surface 20. More specifically, since the journal portion is cylindrical and extends along a preselected length of the shaft, the inner surface 30 of the shroud 28 has a concave semi-cylindrical shape extending, as best shown in FIG. 2, along the length of the journal surface 20. Further, the shroud 28 has a first edge 32 extending along the shaft 12 adjacent the journal surface 20, and a second edge 34 spaced from the first edge 32 as shown in FIG. 1. The shroud 28 is so constructed and positioned that during the coating operation it immediately covers the newly coated area of the shaft; i.e., as the shaft rotates counterclockwise as indicated, a particular area of the journal surface 20 is first coated with melted particles propelled by the plasma spray gun 14, and then that specific area immediately passes under the shroud 28. A pair of conduits 36 extend through the shroud 28 and communicate the inner surface portion 32 of the shroud with a source of pressured gas 38 to supply a continuous flow of gas between the inner surface of the shroud and the coated journal surface 20 during the coating operation.

The flow of gas from the discharge end of the conduits 36; i.e., at the conduit end adjacent the shroud inner surface 30, should be sufficient to dislodge loosely bonded particles from previous passes, provided a protective curtain around the edges of the shroud to divert low-energy, bouncing overspray particles away from the work surface, and cool the journal surface to prevent overheating of the workpiece. It has been found that in the illustrative example of the preferred embodiment shown in FIGS. 1 and 2 and described in more detail below, a gas pressure in the range of 20–40 psi (138–276 kPa) delivered by a pair of 0.25 inch (6.3 mm) O.D. cooper tubes provides sufficient gas flow to meet these operating objectives.

Means 40 is provided for supporting the shroud 28 and maintaining the shaped surface portion 30 of the shroud in a predetermined spaced relationship with respect to the coated surface 20 of the workpiece 12 during the coating operation. In the present apparatus, the shroud 28 is removably mounted on a bracket 42 by a pair of machine screws 44. The bracket is preferably attached to the fixture for rotating the workpiece and includes a hinged joint 46 for ease in moving the shroud 28 to a position spaced from the coated surface area 20 of the workpiece.

INDUSTRIAL APPLICABILITY

In the example of the preferred embodiment, the bearing journal on the workpiece 12 has a diameter of about 2.75 in. (70 mm) and the length of the journal surface 20 is about 2.125 in. (54 mm). The shroud 28 is supported on the bracket 42 and the inner surface 30 of the shroud is shaped to compliment the journal diameter so that an initial clearance of about 0.090 in. to 0.100 in. (2.29 mm to 2.54 mm) is uniformly provided between the inner shroud surface 30 and the journal surface 20 prior to applying the coating. Compressed air at 20 to 40 psi (138–276 kPa) is directed from the tubes 36 onto the journal surface 20, and the crankshaft is axially rotated at about 50–60 rpm about the center of the journal in the direction indicated by arrow 24.

The plasma spray gun 14 is tranversed in the direction indicated by arrow 26, back and forth over the journal surface 20 at a rate of about 3 complete sweeps per minute. A metal alloy powder is introduced through the powder feed tube 16 into the plasma stream and the molten particles are sprayed onto the journal surface 20 at a rate sufficient to deposite a coating from about 0.001 in. to 0.002 in. (0.025 mm to 0.051 mm) for each complete tranverse. The above process is continued until the coating reaches a thickness of about 0.030 in. to 0.060 in. (0.762 mm to 1.524 mm) on the journal surface. If the initial position of the shroud is not changed, the final clearance between the shroud inner surface 30 and the completed coated surface 20 will be in a range from about 0.030 in (0.762 mm) to 0.070 in. (1.78 mm).

In use of the above-described arrangement, the shroud 28 has successfully overcome the problems previously encountered with remote mounted gas nozzles directing one or more streams of gas towards the coating surface. The shroud serves to physically block extraneous or deflected particles from the coating surface. Further, the shroud provides a high velocity flow of gas at the workpiece surface to blow away weakly bonded particles and cool the workpiece.

Other aspects, objects and advantages of this invention can be obtained from a study of the drawings, the disclosure and the appended claims.

I claim:

1. In an apparatus for thermally depositing a coating on a shaft including a means spaced from the shaft for melting a material and propelling the molten material to a surface area on the shaft, means for directing a flow of gas at the coated surface area of the workpiece, and means for rotating the workpiece, the improvement comprising:

a shroud having a semi-cylindrical inner surface spaced from the coated surface of the shaft, a first edge extending along the shaft adjacent said surface area, a second edge spaced from the first edge in the direction of rotation of the shaft, whereby the shroud covers the newly coated area of the shaft; and conduit means for delivering a flow of gas from a source of pressurized gas to the inner surface of said shroud.

2. An apparatus, as set forth in claim 1, wherein said apparatus includes means for supporting the shroud and maintaining the shaped inner surface of the shroud at a position that is spaced a generally uniform distance from about 0.030 in. (0.76 mm) to about 0.100 in. (2.54 mm) from the coated surface area of the workpiece.

3. An apparatus, as set forth in claim 2, wherein the shroud is mounted on the support means for movement between said position and a second position spaced therefrom.

* * * * *